US005339986A

United States Patent [19]

Mihalich

[11] Patent Number: 5,339,986

[45] Date of Patent: * Aug. 23, 1994

[54] METHOD OF DISPENSING BEVERAGE

[76] Inventor: Herman Mihalich, 1134 Knox Ave., Monessen, Pa. 15062

[ * ] Notice: The portion of the term of this patent subsequent to Feb. 1, 2011 has been disclaimed.

[21] Appl. No.: 167,186

[22] Filed: Dec. 16, 1993

Related U.S. Application Data

[60] Division of Ser. No. 303,937, Mar. 27, 1989, Pat. No. 5,282,561, which is a continuation of Ser. No. 76,940, Jul. 13, 1987, abandoned.

[51] Int. Cl.[5] ..... B67D 5/62

[52] U.S. Cl. ..... 222/1; 222/146.6

[58] Field of Search ..... 222/1, 146.1, 146.6; 62/389, 393, 398, 399, 400, 449, 457, 459, 464, 390

[56] References Cited

U.S. PATENT DOCUMENTS

| | | | |
|---|---|---|---|
| 321,970 | 7/1885 | Hoffman . | |
| 683,662 | 10/1901 | Rankin . | |
| 1,139,353 | 5/1915 | Ellis | 222/399 X |
| 1,772,111 | 8/1930 | Rice | 222/146.6 X |
| 1,979,219 | 10/1934 | Bodine | 62/400 X |
| 1,979,549 | 11/1934 | Huckel . | |
| 2,080,598 | 5/1937 | Bodenstab | 222/130 X |
| 2,732,977 | 1/1956 | Charpiat | 222/399 X |
| 2,774,229 | 12/1956 | Thau et al. | 222/146.6 X |
| 2,792,692 | 5/1957 | Bryan | 222/146.6 X |
| 2,917,906 | 12/1959 | Woolley | 222/146.6 X |
| 3,106,074 | 10/1963 | Amburgey, Jr. | 62/464 |
| 3,147,889 | 9/1964 | Dolgin | 222/131 |
| 3,180,529 | 4/1965 | Buffington | 222/131 |
| 3,312,083 | 4/1967 | Scoggins et al. | 62/399 X |
| 3,315,846 | 4/1967 | Landis et al. | 222/399 X |
| 3,327,902 | 6/1967 | Alterwitz | 222/146.1 X |
| 3,331,536 | 7/1967 | DeLorenzo | 222/146.1 X |
| 3,354,668 | 11/1967 | Cserny | 62/389 |
| 3,712,514 | 1/1973 | LeBlanc | 222/399 X |
| 4,225,059 | 9/1980 | Kappos | 222/146.6 |
| 4,272,968 | 6/1981 | Harvill | 62/390 X |
| 4,617,807 | 10/1986 | Pritchett et al. | 62/399 |
| 4,651,538 | 3/1987 | Bull et al. | 222/146.6 X |
| 5,282,561 | 2/1994 | Mihalich | 222/146.6 |

FOREIGN PATENT DOCUMENTS

| | | | |
|---|---|---|---|
| 74623 | 4/1994 | Fed. Rep. of Germany | 62/398 |

*Primary Examiner*—Kevin P. Shaver
*Attorney, Agent, or Firm*—Hymen Diamond

[57] ABSTRACT

The beer dispensed from barrel 29 is cooled by common cooling means 45 in the container before being dispensed and also while flow through the cold plate 61 as it is dispensed. The dispensing of beer which is predominantly foam, "picnic beer," is thus precluded. The cooling is effected through the thermally conducting base 49 of pan 47 which serves as floor for the ice chest 25 and as ceiling for compartment 23 that holds the beer barrel.

3 Claims, 3 Drawing Sheets

METHOD OF DISPENSING BEVERAGE

REFERENCE TO RELATED APPLICATION

This application is a division of application Ser. No. 07/303,937 filed Mar. 27, 1989, now U.S. Pat. No. 5,282,561 which is a continuation of application Ser. No. 07/76,940 filed Jul. 13, 1987 to Herman Mihalich, now abandoned.

BACKGROUND OF THE INVENTION

This invention relates to beverage dispensers and it has particular relationship to readily portable beverage dispensers. The invention will be described herein as applied to a beer dispenser to which it is uniquely applicable. It is understood that to the extent that this invention is adapted to the dispensing of other beverages than beer, such adaptation is within the scope of equivalents of this invention.

Rice, U.S. Pat. No. 1,772,111, typifies the prior art practice in dispensing beverage from portable beverage dispensers. In Rice, the beverage container is disposed in an open compartment. The beverage is supplied from the container to a spout through cooling coils which are contained in a cooling chamber, insulated from the compartment in which the beverage container is disposed. Beer dispensers as disclosed in Rice would produce what is called "picnic beer." A glass or mug of "picnic beer" is mostly foam. Another disadvantage of a dispenser such as is shown in Rice, is that it does not lend itself to use in the home over a period of several weeks. Since only the cooling coils are cooled, the beer in the barrel would remain warm when not in use and would disintegrate and sour over a time interval.

It is an object of this invention to provide a method for dispensing beverage, particularly beer, in whose practice a palatable cold beverage, free of "picnic beer," shall be delivered.

SUMMARY OF THE INVENTION

This invention arises from the realization that the "picnic beer" in a dispenser such as is disclosed by Rice, results from the fact that the beer beverage in a dispenser like Rice's is warm. As the warm beer passes through the cold plate, it is suddenly cooled. The rapid drop in temperature is accompanied by a drop in pressure which produces excessive foam.

In accordance with this invention, there is provided a method of operating a beer dispenser with an ice chest in which the ice chest performs two functions; it cools the beer which flows through the cold plate and it also cools the beer in the barrel before it flows through the ice chest. The beer is cold when it flows into and through the cold plate and "picnic beer" does not flow out of the beer-drawing mechanism because the sharp drop in temperature and pressure of the beer does not occur.

The beer dispenser, for practicing this invention, is an integrated unit including a lower compartment for receiving a beer barrel and an upper compartment including the ice chest. The base of the ice chest serves as at least a part of the roof or ceiling of the lower compartment. The beer barrel is connected to the cold plate in the ice chest. The common base and ceiling is composed of thermally conducting material so that there is thermal interchange between the ice chest, i.e., the ice in the ice chest, and the lower compartment and the beer in the barrel is cooled before it passes through the cold plate. Typically, the container of the ice chest may have the shape of a flanged pot and may be composed of aluminum. The beer-drawing mechanism may be a spigot suspended from the external wall of the ice chest. This has the advantage that the conductor between the outlet of the cold plate and the spigot passes through the ice in the ice chest directly to the spigot and the outflowing beer is maintained cool.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

DETAILED DESCRIPTION OF EMBODIMENT

Figure 5:
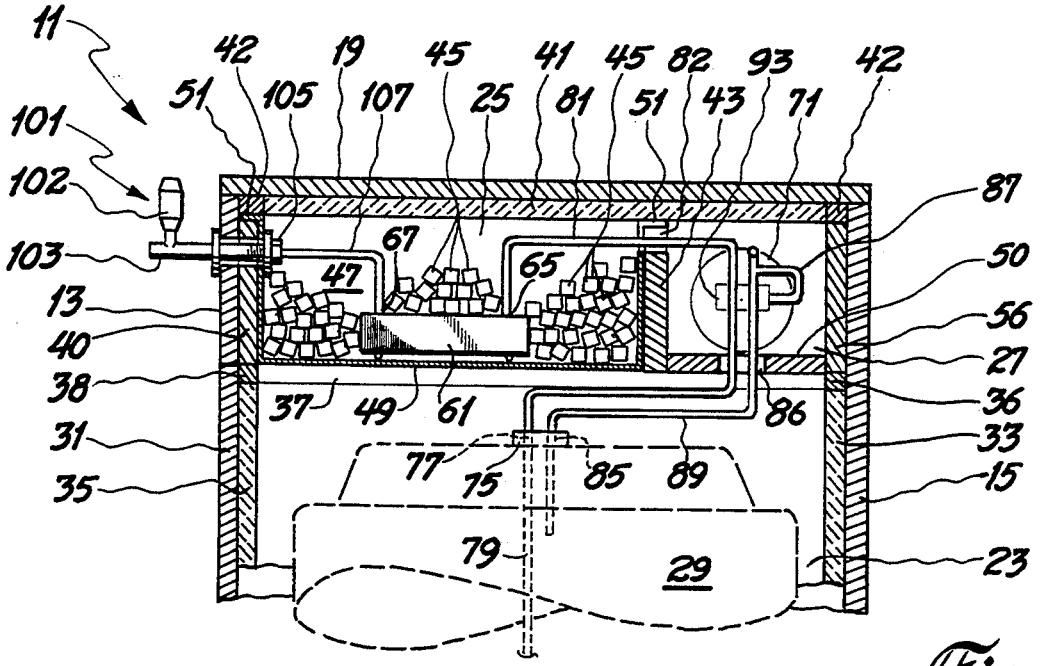
FIG. 5 is a view in longitudinal section taken in the direction V—V of FIG. 2.
Figure 6:
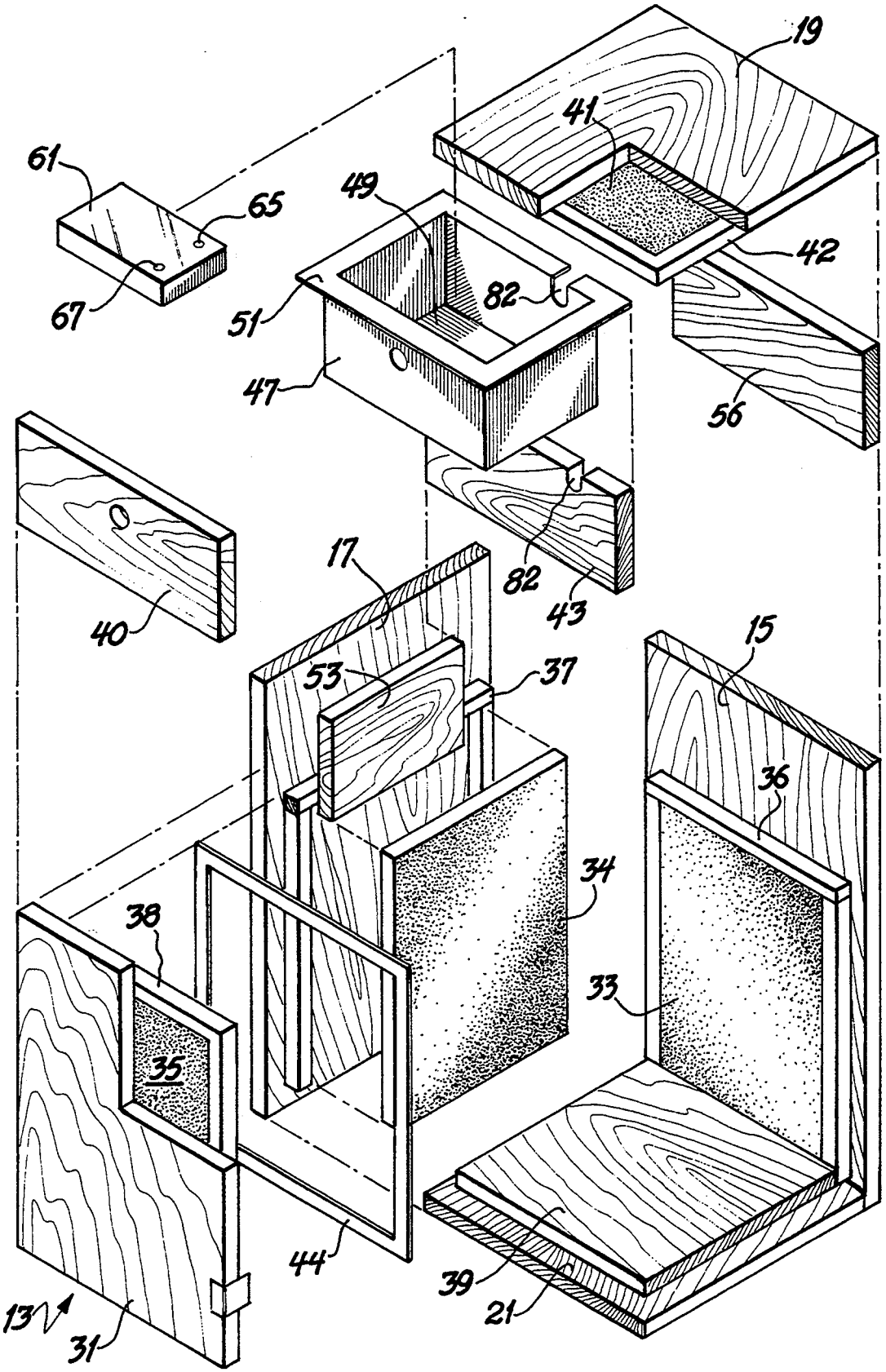
FIG. 6 is a view in isometric showing the principle parts of the beverage dispenser for practicing the method according to this invention.

The drawings show a beverage dispenser 11 in accordance with this invention. The dispenser 11 is an integrated unit in the form of a rectangular parallelapiped whose external front wall 13, rear wall 15 (FIG. 3), side walls 17, top 19 and bottom 21 (FIG. 2) are composed of a material such as plywood. Typically, in its outside dimensions, the dispenser is 37½ inches high by 21 inches square. Within the unit there is a lower compartment or cabinet 23 (FIGS. 2, 5) and a plurality of upper compartments 25 and 27. The lower compartment 23 is dimensioned to receive a beer barrel 29 of a size suitable for use in the home or outdoors at a picnic or cookout, typically a half keg of beer. The lower compartment 23 is provided with a door 31 through which the barrel 29 may be placed in the cabinet. The parts of the rear wall 15 and the side walls 17, which bound the cabinet 23, are lined with thermal insulation 33 (FIGS. 5, 6) and 34, typically styrofoam. The door 31 is also lined with insulation 35 internally. The insulation 33 is held in a frame 36 (FIGS. 5 and 6). The insulation 34 of each side wall is held in a three-sided frame 37. The insulation on the door is held in a frame 38 (FIGS. 5, 6). A strip 40 extends across the top of frame 38 at the entrance to the opening and between the tops of frames 37. The bottom 21 of the dispenser 11 is reinforced by a board 39, typically of plywood. The door frame which is formed by the outer surface ends of the walls 17, of the bottom 21 and of the strip 40, are provided with strips 44 of rubber which serve as a gasket. The top 19 is lined with insulation 41, bounded by a frame 42.

The compartments 25 and 27 (FIG. 5) are separated by a partition 43, typically of plywood. The compartment 25 constitutes the ice chest and in use is filled with ice cubes 45 or contains a block of ice. The cop of compartment 25 is the insulation 41; the sides and bottom are formed by a pan 47 of a thermally conducting material such as aluminum. The bottom of the outer side of the pan 47 abuts the strip 40 (FIG. 6). The base 49 of the pan 47, in addition to serving as the lower boundary of compartment 25, also serves as a part of the ceiling or roof of the lower compartment 23. The ice 45 cools the base 49 by conduction, which in turn cools the barrel 29 by convection and radiation; the barrel cools the beer by conduction. There is effective thermal interchange between the beer and the ice 45. The pan 47 has a flange 51. The pan 47 is mounted in the dispenser with its flange 51 engaged on the three outer sides between the frame members 42 and the insulation 41 which lines the top 19, the upper ends of the reinforcing boards 40, 53 and 55 which line the upper parts of the side walls 17 and the front wall 13. On the fourth side, the flange 51 is engaged between the insulation 41 and the partition 43. The walls 40, 53, 55 and the partition 43 may be seen as an open-ended box.

Figure 1:
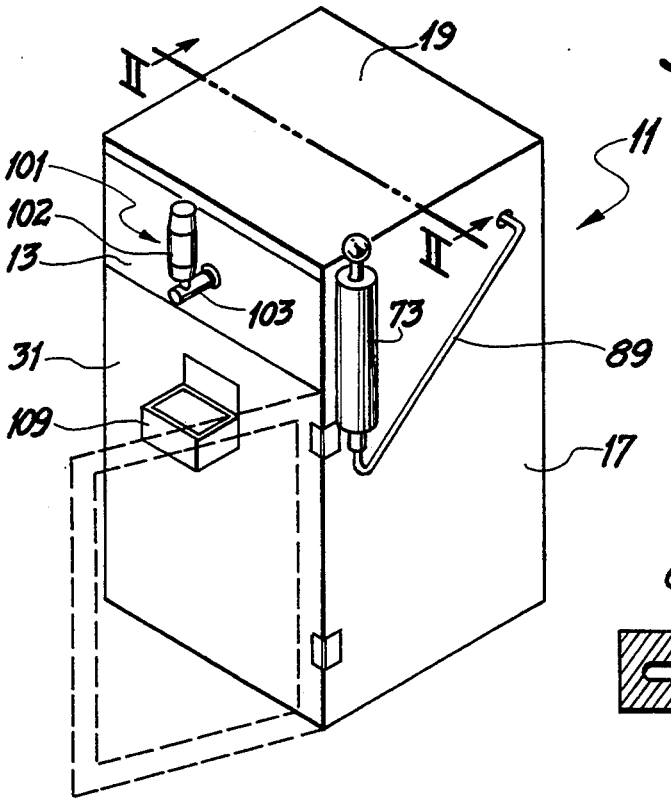
FIG. 1 is a view in isometric of a beverage or beer dispenser for practicing the method of this invention.
Figure 4:
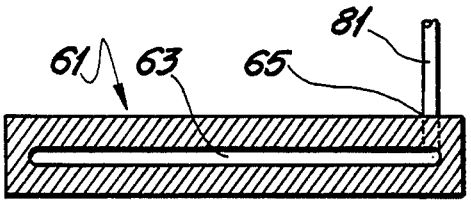
FIG. 4 is a fragmental view in longitudinal section taken in the direction IV—IV of FIG. 3.
Figure 3:
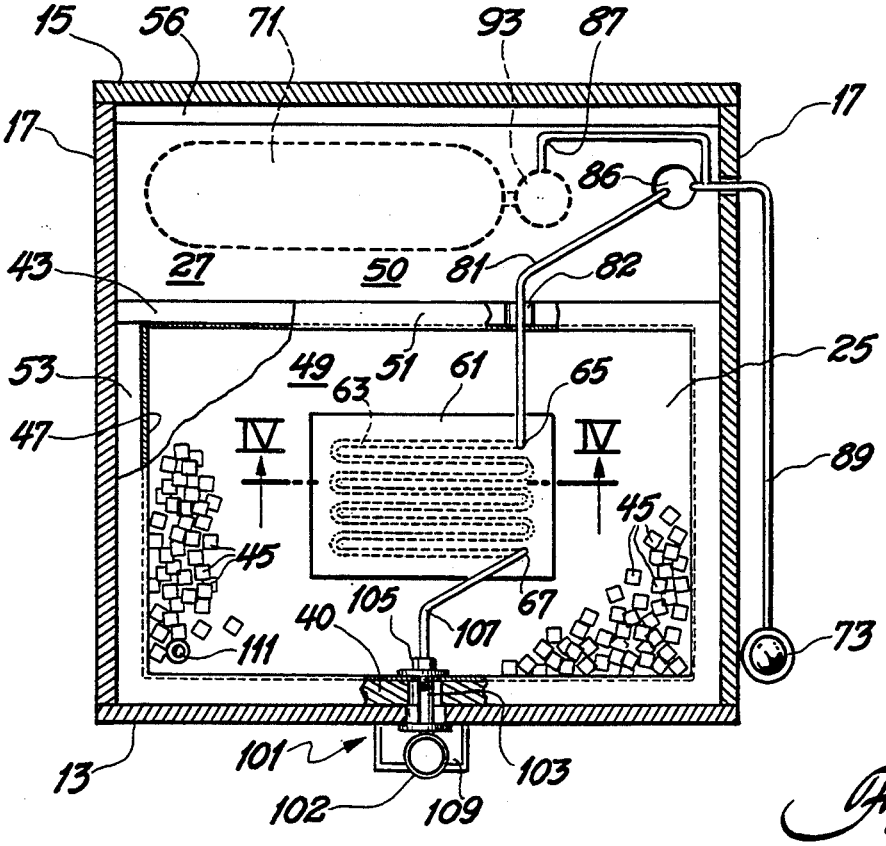
FIG. 3 is a view in transverse section taken along line III—III of FIG. 2.

A cold plate 61 is disposed in the compartment 25. The cold plate 61 is a block composed typically of aluminum within which there is a sinusoidal passage 63 (FIGS. 3, 4) through which the beer is conducted and cooled. The cold plate 61 has an inlet 65 and outlet 67 (FIGS. 3, 5). It is desirable that the cold plate 61 have the same metallic composition as the pan 47 to preclude corrosion from a battery effect.

The compartment 27 may contain a $CO_2$ tank 71 for supplying gas to produce the flow of beer as demanded. A hand pump 73 is mounted on one of the side walls 17 as an alternative for the same purpose.

Figure 2:
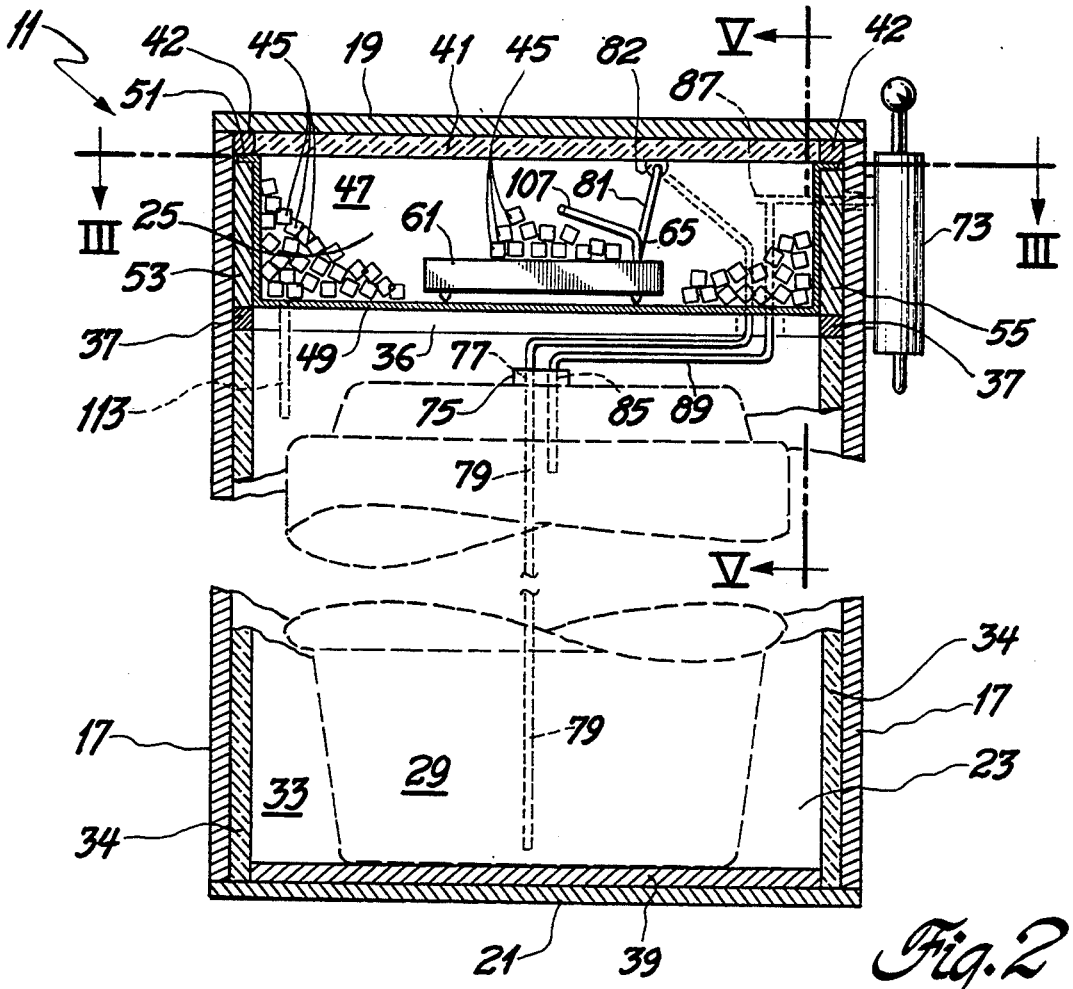
FIG. 2 is a view in longitudinal section taken in the direction II—II of FIG. 1.

The beer barrel 29 has a tap 75 (FIGS. 2 and 5). The tap 75 includes a bore 77 for drawing beer. The bore 77 is connected to a long tube 79, which extends substantially to the bottom of the barrel. A conductor or tube 81 (FIGS. 2, 3, 5) is provided for connecting the tube 79 to the inlet 65 of the cold plate 61. The conductor 81 passes through a hole 86 in the base 50 of the compartment 27 between the inlet 65 and the bore 77. The tap 75 also has a bore 85 which opens over the surface of the beer. Conductors 87 and 89 (FIG. 3) are provided for connecting the valve 93 of the tank 71 or from the pump 73 to the bore 85. Conductors 87 and 89 are passed through the hole 86. Pressure is provided either through conductor 87 or conductor 89 to drive the beer through conductor 81.

A spigot assembly 101 including a spigot 102 is mounted centrally on the front wall above the door 31. The spigot assembly 101 includes an externally threaded hollow member 103 (FIG. 5) which penetrates through holes in the wall 13, the board 40 and the pan 47. The spigot assembly is secured by a nut 105 which also secures the pan to the board 40. The hollow member 103 is connected to the outlet 67 of the cold plate 61 by conductor 107. The conductor 107 passes directly to the spigot 102 through the ice 45 which maintains the beer cold. A drain pad 109 is mounted on the door 31 vertically below the spigot 102.

The pan 47 is provided with a drain hole 111 in a corner. The drain hole 111 is connected to a tube of conductor 113. The water from the melting ice 45 is drained through the hole 111 and tube 113.

This invention provides a method of dispensing a beverage, specifically beer, in whose use "picnic beer" is avoided. When this method is precluded in the home, it has the additional advantage of maintaining the beer cold and preventing its becoming sour even if the beer in a barrel is dispensed over a period of weeks. All that is necessary is that typically ten pounds of ice be added to the ice chest periodically as necessary.

While preferred practice of this invention has been disclosed herein, many modifications thereof are feasible. This invention is not to be restricted, except insofar as is necessitated by the spirit of the prior art.

I claim:

1. The method of dispensing beverage from a container with apparatus including an ice tray, the said method comprising: by common cooling means cooling the ice tray and precooling the beverage in the container and conducting the beverage cooled in the container to dispensing means from the container through the ice tray, the precooling of the beverage in the container being to a sufficiently low temperature to suppress the formation predominantly of foam in the dispensed beverage.

2. The method of dispensing beverage from a container having a first compartment for holding the beverage and a second compartment for holding ice for cooling the beverage, said container having a thermally conducting wall common to the first and second compartments; said method comprising: precooling the beverage while in the first compartment by the cooling effect of the ice penetrating through the thermally conducting wall from the second compartment to the first compartment, and conducting the cooled beverage from the first compartment through the second compartment to dispense the beverage, thereby further cooling the beverage being dispensed by the cooling effect of the ice in the second compartment, the beverage being dispensed being cooled in the first compartment to a low-enough temperature to preclude the formation of beverage which is predominantly foam.

3. The method of claim 2 wherein the second compartment includes a cold plate directly cooled by the ice characterized by that in being dispensed by conduction through the second compartment, the beverage is conducted through the cold plate.

* * * * *